US010918575B2

(12) United States Patent
Yan et al.

(10) Patent No.: US 10,918,575 B2
(45) Date of Patent: Feb. 16, 2021

(54) INTELLIGENT DRIPPING PILL MACHINE FOR CONTINUOUS LIQUID SOLIDIFICATION

(71) Applicant: TASLY PHARMACEUTICAL GROUP CO., LTD., Tianjin (CN)

(72) Inventors: Kaijing Yan, Tianjin (CN); Xiaobing Sun, Tianjin (CN); Changsheng Rong, Tianjin (CN); Xuefei Cai, Tianjin (CN); Liang Wang, Tianjin (CN)

(73) Assignee: Tasly Pharmaceutical Group Co., LTD., Tianjin (CN)

( * ) Notice: Subject to any disclaimer, the term of this patent is extended or adjusted under 35 U.S.C. 154(b) by 491 days.

(21) Appl. No.: 15/760,441

(22) PCT Filed: Sep. 14, 2016

(86) PCT No.: PCT/CN2016/099019
§ 371 (c)(1),
(2) Date: Mar. 15, 2018

(87) PCT Pub. No.: WO2017/045610
PCT Pub. Date: Mar. 23, 2017

(65) Prior Publication Data

US 2018/0263851 A1 Sep. 20, 2018

(30) Foreign Application Priority Data

Sep. 18, 2015 (CN) ..... 2015 1 0598440

(51) Int. Cl.
*A61J 3/06* (2006.01)

(52) U.S. Cl.
CPC ..... *A61J 3/06* (2013.01)

(58) Field of Classification Search
CPC ..... A61J 3/06; B01F 1/0011; B01F 15/0201; B01F 15/065; B01F 2015/062; B01F 2015/0204
See application file for complete search history.

(56) References Cited

U.S. PATENT DOCUMENTS 2,911,672 A 11/1959 Erven et al.
4,773,833 A 9/1988 Wilkinson et al.
(Continued)

FOREIGN PATENT DOCUMENTS

CN 101400340 A 4/2009
CN 101744722 A 6/2010
(Continued)

OTHER PUBLICATIONS

International Patent Application No. PCT/CN2016/099019; Int'l Written Opinion and the Search Report; dated Dec. 8, 2016; 10 pages.
(Continued)

*Primary Examiner* — Robert J Grun
(74) *Attorney, Agent, or Firm* — BakerHostetler

(57) ABSTRACT

An intelligent dripping pill machine for continuous liquid solidification comprises: a feeding device (1), a material combining device (2), a homogenizing device (3), a dripping device (4) and a de-oiling device (5) sequentially connected via a transmission channel. The intelligent dripping pill machine removes, via high-speed centrifugation, a cooling liquid attached to dripping pills, and each component device is connected compactly, thereby achieving a continuous manufacturing operation, and reducing an occupied space of the devices as a whole while ensuring the yield of the dripping pills.

12 Claims, 6 Drawing Sheets

(56) References Cited

U.S. PATENT DOCUMENTS

| | | | |
|---|---|---|---|
| 2005/0037094 | A1 | 2/2005 | Yan et al. |
| 2013/0242689 | A1 | 9/2013 | Alsewailem |

FOREIGN PATENT DOCUMENTS

| | | | |
|---|---|---|---|
| CN | 201816208 | U | 5/2011 |
| CN | 101647754 | B | 11/2011 |
| CN | 103273358 | A | 9/2013 |
| CN | 103273582 | A | 9/2013 |
| CN | 203355892 | U | 12/2013 |
| CN | 203710386 | U | 7/2014 |
| CN | 104274323 | A | 1/2015 |
| CN | 104274327 | A | 1/2015 |
| CN | 204170104 | U | 2/2015 |
| CN | 204207592 | U | 3/2015 |
| CN | 204233450 | U | 4/2015 |
| CN | 204411297 | U | 6/2015 |
| CN | 106539689 | A | 3/2017 |
| EP | 0515997 | A1 | 12/1992 |
| EP | 1832281 | A1 | 9/2007 |
| TW | M487076 | U | 10/2014 |
| WO | WO 2001/089679 | A2 | 11/2001 |
| WO | WO 2009/051278 | A2 | 4/2009 |
| WO | WO 2009/134848 | A1 | 11/2009 |

OTHER PUBLICATIONS

"Smart Feeding Solutions for Bulk Material Processing"; Coperion K-Tron Technologies; 8 pages.

European Patent Application No. 16845724.0; Extended Search Report; dated Jul. 22, 2019; 16 pages.

INTELLIGENT DRIPPING PILL MACHINE FOR CONTINUOUS LIQUID SOLIDIFICATION

CROSS-REFERENCE TO RELATED APPLICATIONS

This application is the National Stage of International Application No. PCT/CN2016/099019, filed Sep. 14, 2016, which claims the benefit of Chinese application number 2015105984406, filed Sep. 18, 2015 the disclosures of which are incorporated herein by reference in their entireties.

TECHNICAL FIELD

The present invention relates to the technical field of drug manufacturing, especially relates to manufacturing equipment for drugs of dripping pill kind and more specifically relates to an intelligent dripping pill machine for continuous liquid solidification.

BACKGROUND ART

The dripping pill is a traditional dosage form in traditional Chinese medicine preparations and is universally recognized because of many advantages such as short manufacturing cycle, rapid effect, high drug stability and convenience in carrying and storage.

The existing manufacturing equipment for dripping pills has the following defects: 1. as a liquid cooling way is always adopted, liquid-solid separation of the dripping pills from a cooling liquid is required, and it is relatively difficult to thoroughly separate the dripping pills from the cooling liquid, it is inevitable that the cooling liquid may remain on the dripping pills, thus leading to contamination of the dripping pills. 2. as a relatively large paraffin heat exchange surface area is required, the recycling efficiency is low, and the energy consumption is high, leading to the volume and occupied space of the equipment is excessively large, dead corners hard to clean are easy to be existed, and risks of cross contamination are high.

The development trend and research direction for the improvement on the current dripping pill equipment lies in how to improve the existing dripping equipment to effectively separate the dripping pills from the cooling liquid in an efficient manner while reducing energy consumption and the usage amount of the cooling liquid, avoiding contamination of the dripping pills and reducing the occupied space of the devices as a whole.

SUMMARY OF THE INVENTION

Aimed at the above-mentioned problems existing in the prior art, the object of the present invention is to provide an intelligent dripping pill machine for continuous liquid solidification. The intelligent dripping pill machine removes, via high-speed centrifugation, a cooling liquid attached to dripping pills, and optimization and adjustment are performed on devices in various manufacturing links to realize compact connection between various component devices, thereby achieving a continuous manufacturing operation, and reducing the occupied space of the equipment as a whole while ensuring the yield of dripping pills.

In order to achieve the aim, the present invention employs the following technical solution:

An intelligent dripping pill machine for continuous liquid solidification comprises:

a feeding device, a material combining device, a homogenizing device, a dripping device and a de-oiling device sequentially connected via a transmission channel.

Further, the feeding device is a weightless feeding device comprising a hopper, a weighing sensor, a screw transmission device and a discharging hole.

Further, the material combining device comprises a solid feeding hole, a liquid feeding hole, a driving device, a twin-screw structure connected with the driving device, a host shell covering the twin-screw structure, a discharging hole formed in one end of the host shell and a plurality of heaters arranged on the outer wall of the host shell; the twin-screw structure is sequentially divided into a solid feeding section, a liquid feeding section, a material combining section, a de-gassing section and a transmission section; the solid feeding hole is located above a solid feeding section, and the screw of the twin-screw structure on the solid feeding section is of a variable-pitch structure; the liquid feeding hole is located above a liquid feeding section, and the screw of the twin-screw structure on the liquid feeding section is of a uniform-pitch structure; and the twin-screw structure of the material combining section is an engaged structure.

Further, the homogenizing device comprises a material channel, a pressure gauge and a homogenizing pressure regulating valve disposed above the material channel.

Further, the dripping device comprises:

a dripping tray;

a balance cylinder used for feeding to the dripping tray via a line;

a vibration device connected with the dripping tray and used for driving the dripping tray to vibrate at a vibration frequency of 10-500 Hz;

a charging barrel having a height of 1-10 m and a diameter of 100-1000 mm and being used for containing liquid paraffin, wherein the dripping tray is 300-1000 mm away from the top of the liquid level of the paraffin;

the dripping device further comprises: a cooling device comprising a compressor, a heat exchanger and a pump; a discharging hole; an oil filtering device; an oil storage container and a paraffin oil transmission line.

Further, the de-oiling device comprises:

a horizontal driving shaft; and a spiral separator rotating around the horizontal driving shaft as the center and having a spiral transmission channel, wherein an inlet of the spiral transmission channel is in communication with a distribution hopper, and a plurality of de-oiling holes with sizes smaller than those of the dripping pills are opened at one side of the spiral transmission channel.

Further, the spiral transmission channel comprises a tapered side wall;

a tapered basket covering the outside of the tapered side wall, wherein the above de-oiling holes are all formed at the side of the tapered basket; an annular gap is formed between the tapered side wall and the tapered basket, wherein a spiral track is disposed in the annular gap, and the tapered side wall, the tapered basket and the spiral track form the spiral transmission channel;

the tapered side wall has a wide-necked end and a closing-in end, wherein the closing-in end is connected with the distribution hopper, and an outlet of the spiral transmission channel is located in the wide-necked end.

Further, the number of turns of the spiral track is not less than 3, and the spiral lead angle is 5-30°.

Further, the taper of the tapered side wall is 0-25°.

Due to the adoption of the technical solution, the following beneficial effects may be obtained:

1. the dripping pill machine provided by the present invention adopts a continuous manufacturing manner, thus achieving flexible batches and consistent and stable quality in products between batches, the production capacity of the overall machine may reach to 100 kg/h, material residues are less than 5 kg, and the dose accuracy may be up to 0.5%;

2. feeders of the intelligent dripping pill machine adopt weightless feeders by which materials are provided for ensuring continuous manufacturing, the materials are accurately weighed; and the feeding accuracy is controlled to be 0.5%. The movement processes of all the materials in a barrel of the material combining device are identical, and the materials are sufficiently mixed under the action of high shearing and kneading forces, so that the quality of products and the manufacturing efficiency are greatly improved. The duration of a material combining process is short, and no organic solvents or water is used. When a drug is dispersed in the equipment at a molecular level, the bioavailability can be increased. The whole process is simple, coherent and efficient. According to the adoption of the technical solution, such problems as limitation on batch and time of material combining, large equipment volume, low energy utilization rate and low manufacturing efficiency in the existing equipment are solved, and therefore, the application prospect is wide.

3. for the dripping device, according to the adoption of the technical solution of the present invention, such problems as limitations on the sizes of dripping pills manufactured by the existing equipment, large equipment volume, low energy utilization rate and cleaning difficulty caused by numerous dead corners of the equipment are solved; and according to the adoption of the technical solution of the present invention, a pressure regulating valve at an outlet of the homogenizing device may be regulated to regulate the sizes of the dripping pills, without changing drippers, and therefore, the application prospect is wide.

4. for the de-oiling device, the de-oiling manner of the traditional vertical centrifuge is changed to be horizontal. It may be realized that:

1) a continuous working centrifuge continuously feeds and discharges the materials;

2) solid particles do not form a dense layer, but independently slide through screening regions which are arranged gradually;

3) the oil-water separation effect is good;

4) the continuous Manufacturing is realized, and the manufacturing efficiency is high.

According to the adoption of the technical solution of the present invention, such problems of poor de-oiling effect, need of auxiliary oil coating equipment, limitation on batch manufacturing and manufacturing efficiency, large equipment volume and low energy utilization rate existing in the existing equipment are solved, and the application prospect is wide.

DETAILED DESCRIPTION OF THE INVENTION

Embodiments are specifically exampled below and are matched with the drawings to describe the present invention in detail below in order to make the characteristics and advantages of the present invention more readily apparent.

Figure 1:
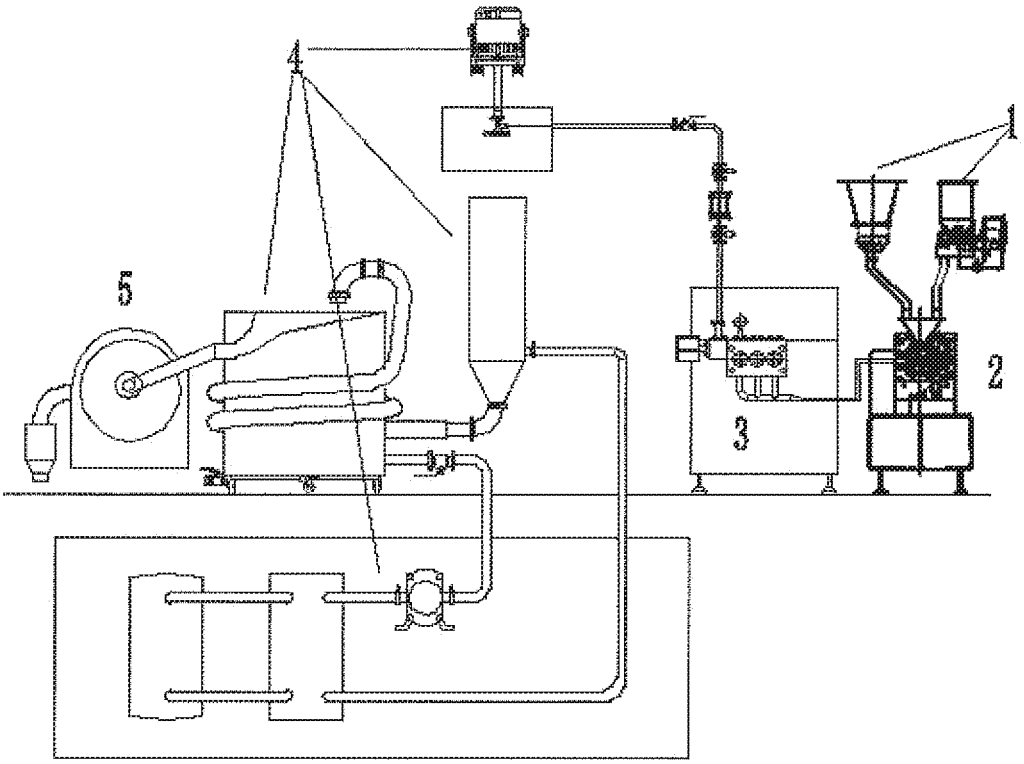
FIG. 1 is a schematic structural diagram of an intelligent dripping pill machine for continuous liquid solidification in an embodiment of the present invention.

As shown in FIG. 1, an intelligent dripping pill machine for continuous liquid solidification comprises a feeding device 1, a material combining device 2, a homogenizing device 3, a dripping device 4 and a de-oiling device 5 sequentially connected via a channel. The arrangement manner and connecting relationship of each component part are specifically described below by combining with FIG. 1: the feeding device 4 is arranged above each feeding hole of the material combining device 2, and a discharging hole of the material combining device 2 is connected with the homogenizing device 3 placed in parallel to the material combining device 2 by a transmission channel; an outlet of the homogenizing device 3 is connected to a dripping tray of the dripping device 4 by a transmission channel; and a discharging hole of the dripping device 4 is connected with the de-oiling device 5 by a transmission channel. The amount of each component part is set as one only, so that a compact continuous production line is formed.

Component devices are compactly connected to realize continuous manufacturing operation due to the arrangement and combination with structural regulation on each component device. The area of the occupied space of the dripping pill machine as a whole is only about 60 $m^2$, so that not only the dependency on a manufacturing field is reduced, but also the regulation and maintenance are conveniently realized.

The structure and working Manner of each device are described in detail below in conjunction with the drawings:

1. Feeding Device

Figure 2:
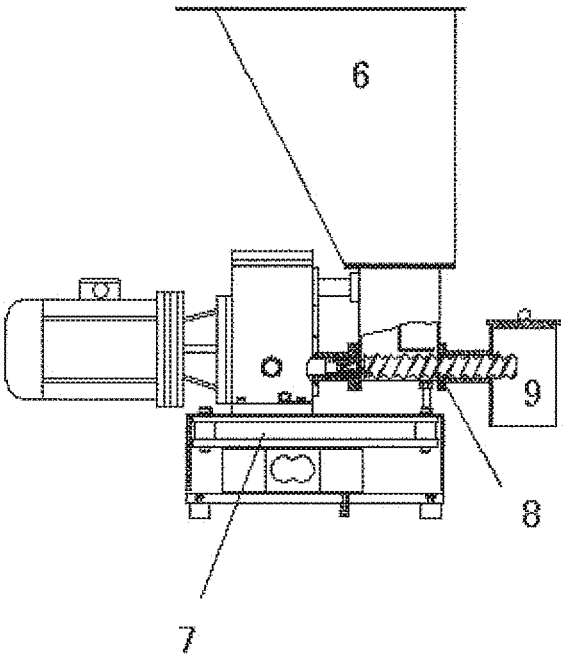
FIG. 2 is a schematic structural diagram of a feeding device in an embodiment of the present invention.

The feeding device 1 may comprise one or more groups of feeders, and each group of feeders is composed of a hopper 6, a weighing sensor 7, a screw transmission device 8 and a discharging hole 9, wherein the structure of one group of feeder is shown in FIG. 2. The amount of groups of feeders is consistent with the amount of kinds of materials.

Each kind of the materials (including extracts, excipients and the like) is respectively fed into the feeding device by the hopper 6, is transmitted by the screw transmission device 8 to enter the discharging hole 9 after being accurately weighed by the weighing sensor 7, and then, enters the material combining device. Wherein, the feeders of the present invention are weightless feeders, namely the materials enter the weighing sensor by virtue of the self-gravity and are weighed, and the quantity of the materials entering the dripping pill machine may be regulated at any time according to the manufacturing requirement, so that the aim of continuous manufacturing is achieved. However, it should be noted that the extracts in the materials is relatively poor in flowability because of belonging to a liquid or semi-solid form, so that a liquid feeder needs to be additionally configured with a pump to assist the weightless feeders in feeding the liquid or semi-solid extracts into the weighing sensor.

2. Material Combining Device

Figure 3:
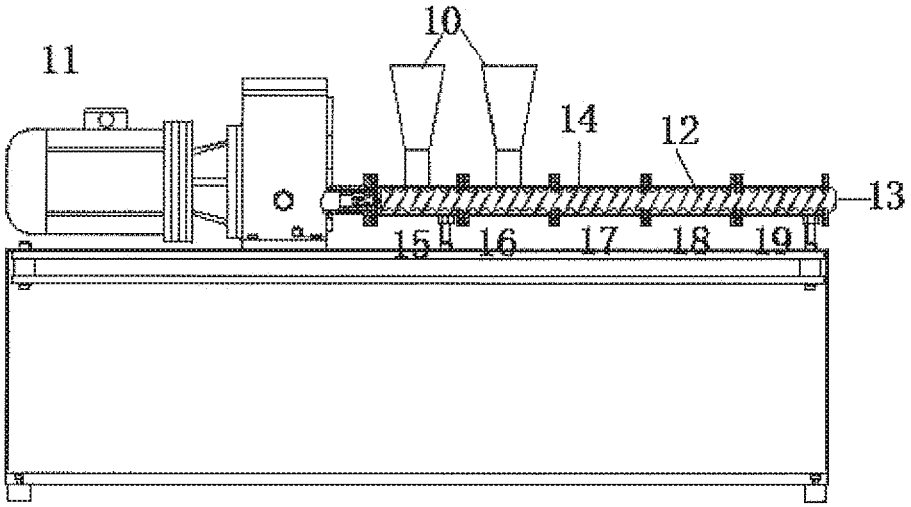
FIG. 3 is a schematic structural diagram of a material combining device in an embodiment of the present invention.

As shown in FIG. 3, the material combining device is composed of feeding holes 10, a motor 11, a twin-screw structure 12, a discharging hole 13 and heaters 14, wherein two feeding holes are provided, i.e. a solid feeding hole and a liquid feeding hole respectively. The twin-screw structure may be divided into 5-7 sections which are respectively a solid feeding section 15, a liquid feeding section 16, a material combining section 17, a de-gassing section 18 and a transmission section 19, wherein the amount of each of the material combining section, the de-gassing section and the transmission section may be one or more sections and may be increased as required; wherein an element on the solid feeding section has a variable pitch, an element on the liquid feeding section has a uniform pitch, and the pitch ranges of the two sections are both 10-30 mm. The material combining section is an engaging element. The solid feeding hole is connected with the solid feeding section in the twin-screw structure, and the liquid feeding hole is connected with the liquid feeding section in the twin-screw structure. The four walls of a twin-screw host are provided with the heaters of which the heating temperatures may be regulated within the range of 0-200° C., wherein the temperature of each section is different.

After solid materials and liquid materials respectively enter the material combining device from the solid feeding hole and the liquid feeding hole, the solid materials enter the solid feeding section of the twin-screw structure, an the solid feeding section, the solid materials are transmitted by a screw while being heated to 50±10° C., then, enter the liquid feeding section, and are mixed with the liquid materials entering the liquid feeding section via the liquid feeding hole, and are heated to 55±10° C., and then, sequentially enter the material combining section to realize mixing, the de-gassing section to remove air bubbles and the transmission section to realize transmission, the temperature of each section is increased by 0-10° C., and when the materials are discharged from the transmission section and enter the homogenizing device via a channel, the temperature of an inlet of the homogenizing device is lower than 80° C., preferably, 60-70° C.

The time for materials passing through the material combining device is shorter than 60 s, preferably, shorter than 30 s.

A discharging pipe of the material combining device is connected with a feeding pipe of the homogenizing device.

3. Homogenizing Device

Figure 4:
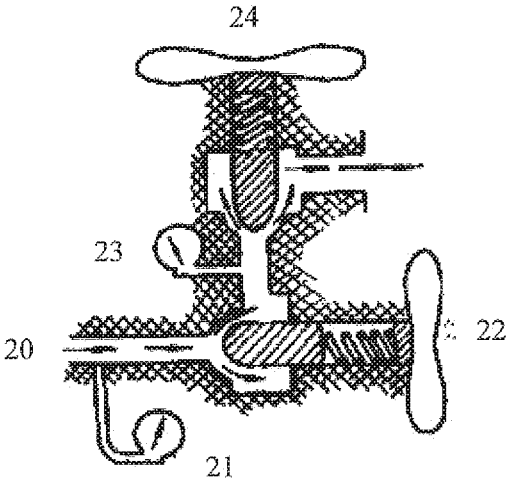
FIG. 4 is a schematic structural diagram of a homogenizing device in an embodiment of the present indention.

As shown in FIG. 4, the homogenizing device comprises the feeding pipe 20, a first-stage homogenizing pressure gauge 21, a first-stage homogenizing valve 22, a second-stage homogenizing pressure gauge 23 and a second-stage homogenizing valve 24.

After the materials enter the homogenizing device, the pressure is regulated to be 500-2000 MPa by the two stage homogenizing valves. High-pressure homogenization is performed under the action of pressure, so that the materials are further uniformly dispersed to realize nano-scale dispersion. Meanwhile, the temperatures of the materials are continuously raised by 10-20° C. under the action of a friction force and the temperature at an outlet of the homogenizing device can reach to 80-100° C., preferably 90-95° C.

4. Dripping Device

Figure 5:
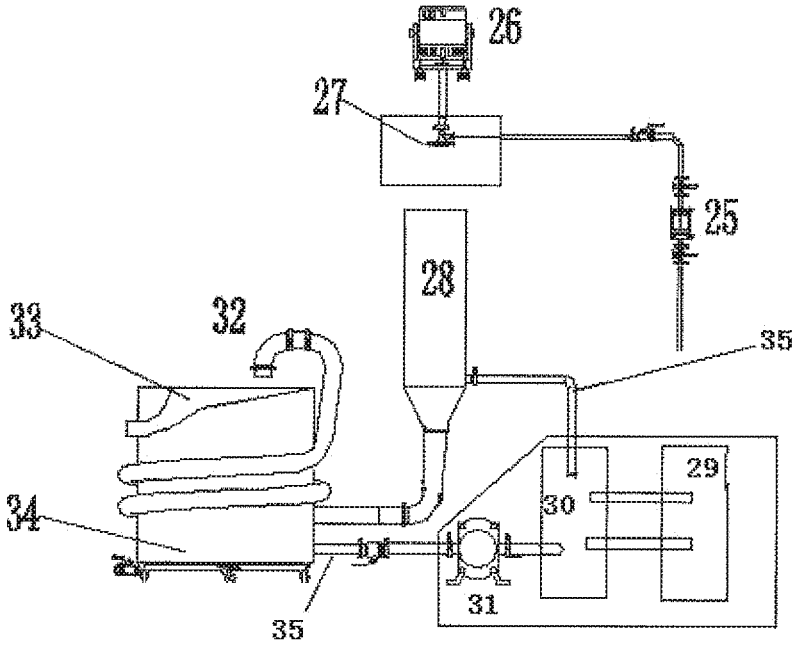
FIG. 5 is a schematic structural diagram of a dripping device in an embodiment of the present invention.

As shown in FIG. 5, the dripping device is composed of a balance cylinder 25, a vibration device 26, a dripping tray 27, a charging barrel 28, a cooling device (comprising a compressor 29, a heat exchanger 30 and a pump 31), a discharging hole 32, an oil filtering device 33, an oil storage container 34 and a paraffin oil transmission line 35. The vibration device is located above the dripping tray and is connected with the dripping tray, the dripping tray has one to More drippers of which openings are downward, and the charging barrel is located under the dripping tray. Liquid paraffin is stored in the cooling device, cooled by the heat exchanger 30 and enters the charging barrel via the transmission line 35. A connecting port of the transmission line 35 and the charging barrel 28 is located in the upper part of a reducing part of the charging barrel and is vertical to the charging barrel. The initial temperature of the liquid paraffin entering the charging barrel is −15-25° C. With the rise of the liquid level of the liquid paraffin in the charging barrel, the temperature is also gradually raised from bottom to top to form a temperature gradient of −15-60° C. The viscosity of the paraffin can be controlled by controlling the temperature gradient of the liquid paraffin in the charging barrel. The drippers are 300-1000 mm away from the top of the liquid level of the paraffin. The charging barrel has a height of 1-10 m and a diameter of 100-1000 mm.

The materials enter the dripping tray 27 from the discharging hole of the homogenizing device via the balance cylinder 25, and the vibration device 26 generates vibration an the dripping tray to make the materials drip, wherein the vibration frequency of the drippers is 10-500 Hz.

Figure 6:
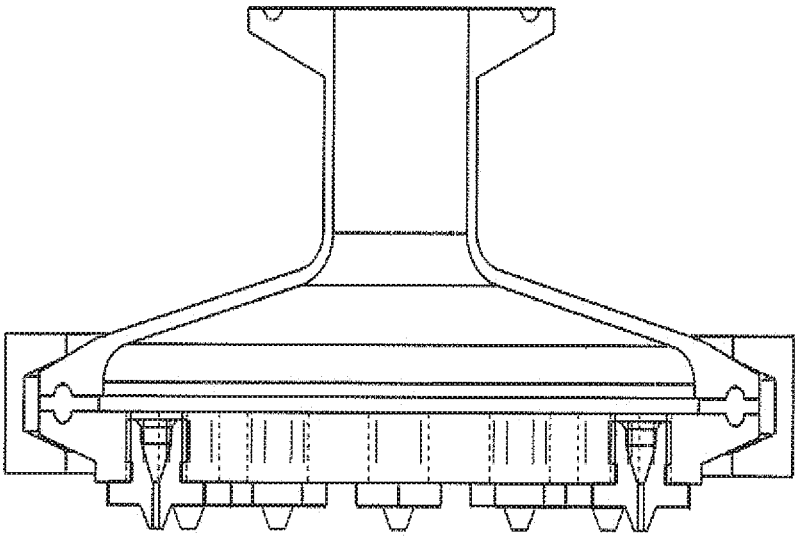
FIG. 6 is a schematic structural diagram of a dripping tray in an embodiment of the present invention.

The structural diagram of the dripping tray is referred to FIG. 6, and the structure of the dripping tray is basically same as that of the dripping tray disposed on the traditional dripping pill equipment and is not described again herein.

Figure 7:
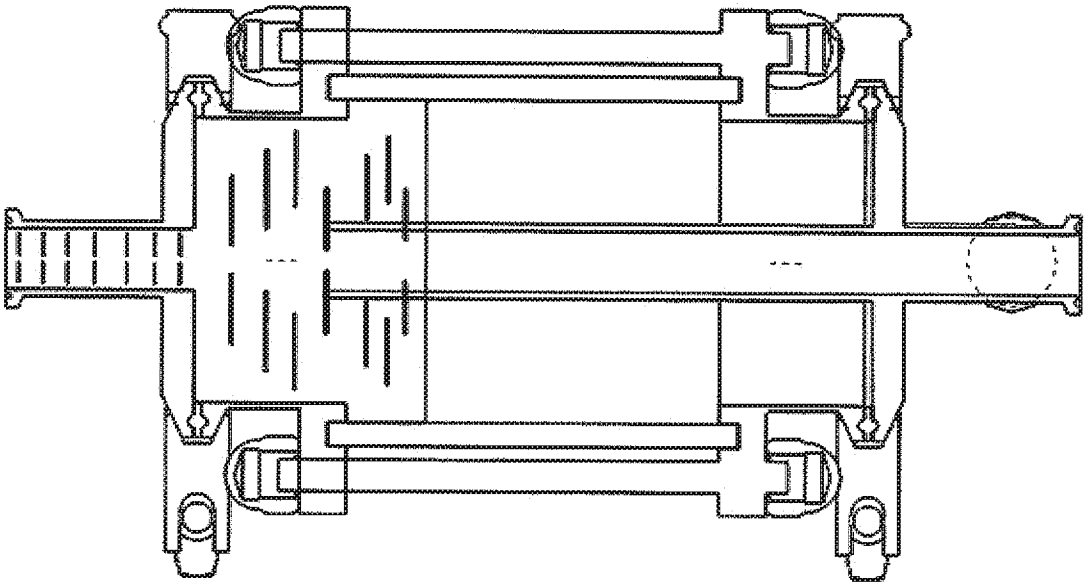
FIG. 7 is a schematic structural diagram of a balance cylinder in an embodiment of the present invention.

As shown in FIG. 7, the balance cylinder is of a hollow structure and is filled with air, one end of the balance cylinder is connected with the homogenizing device via a channel, the other end of the balance cylinder is connected with the dripping tray via a channel, and the two channels are not connected inside the balance cylinder. The air in the balance cylinder can play a buffering role, and the materials can smoothly pass through the balance cylinder due to pressure balance. The sizes of the dripping pills can be controlled by regulating the pressure at the outlet of the homogenizing device. When the pressure at the outlet of the homogenizing device is increased, the materials through the balance cylinder are increased, the diameters of the dripped dripping pills are also increased; and vice versa. It's found by researches of inventors that, the dripping diameters of the dripping pills can be controlled at 1-10 mm by regulating the pressure at the outlet of the homogenizing device to be 0.05-5 MPa, without changing the drippers.

After the materials fall into the charging barrel via the drippers, the dripping, pills are formed, the dripping pills enter the oil filtering device 33 together with the liquid paraffin via the discharging hole 32; the oil filtering device is of a screen mesh structure which exists in the prior art and may be selected from the following structures: structures including, but not being limited to a planar structure, an arc-shaped structure or a funnel-shaped structure; holes with the diameters of 1-5 mm are distributed in a screen mesh, and the dripping pills enter the de-oiling device via an outlet after the dripping pills and the paraffin are primarily filtered by the screen mesh structure. The filtered-out liquid paraffin enters the cooling device again via the transmission channel 35 so as to be recycled.

The time for dripping the dripping pills by using the materials is shorter than 60 s, preferably, shorter than 30 s.

5. De-Oiling Device

Figure 8:
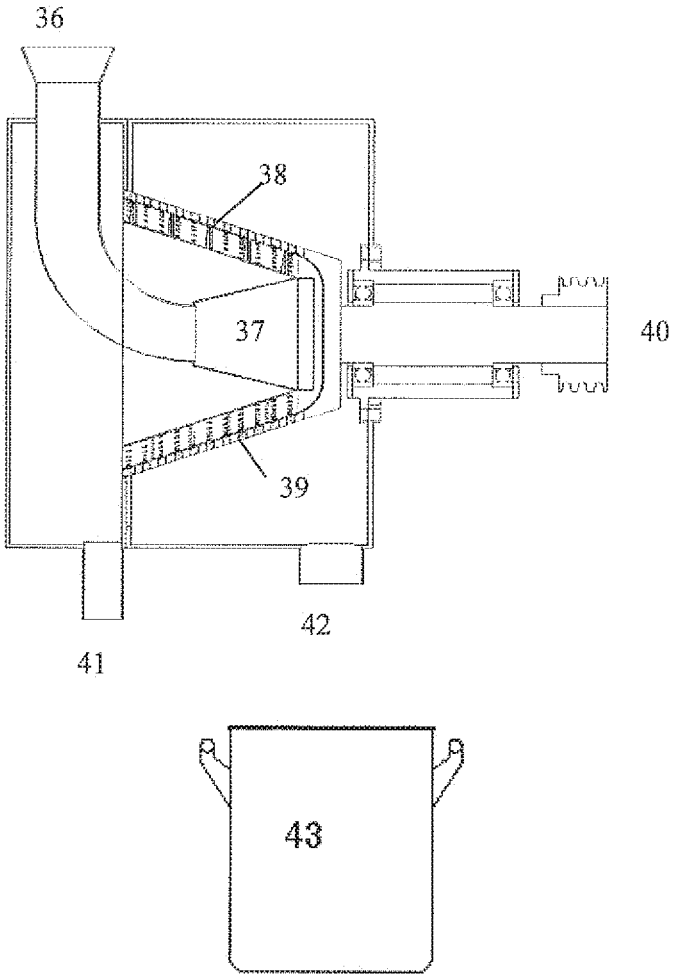
FIG. 8 is a schematic structural diagram of a de-oiling device in an embodiment of the present invention.
Figure 9:
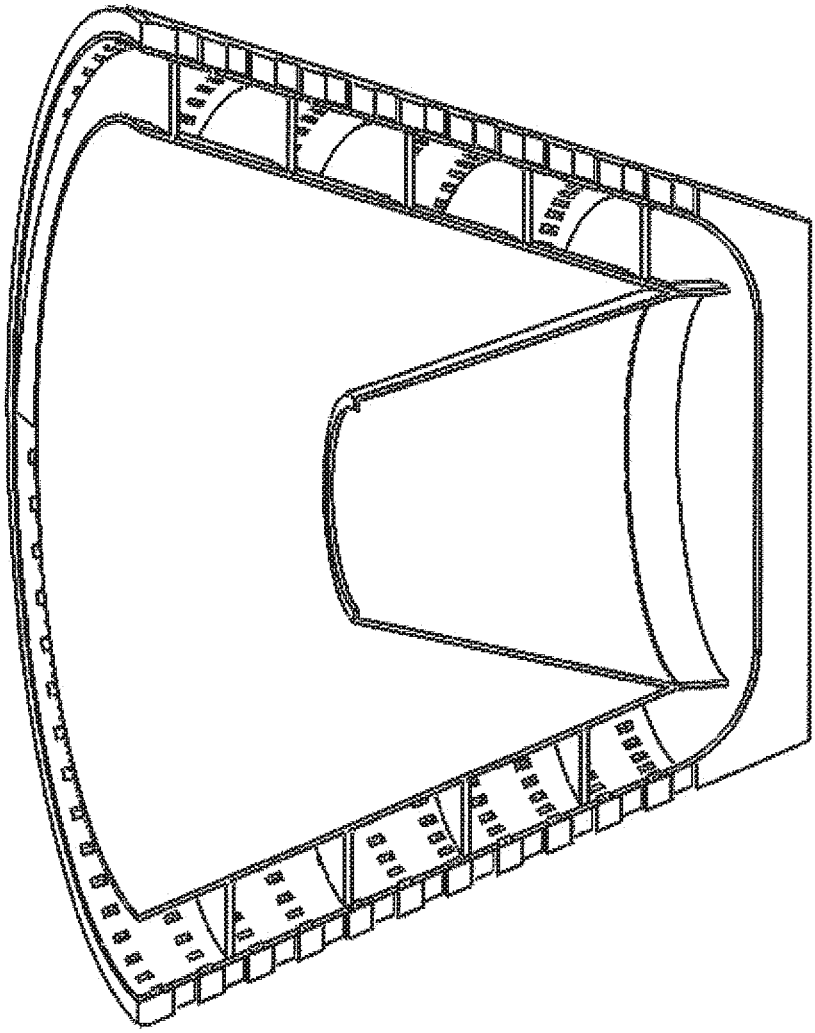
FIG. 9 is a schematic structural diagram of a spiral separator in an embodiment of the present invention.

As shown in FIG. 8 and FIG. 9, a feeding hole 36 is connected with a dripping pill outlet of the oil filtering device, the dripping pills which are primarily filtered enter the transmission channel via the feeding hole 36 and reach to the distribution hopper 37, and enter a spiral separator 38 and rotate with the spiral separator 38 and a tapered basket 39 at high speed along a driving shaft 40 in a horizontal direction, and the accelerated speed is 500-2000 G. The diameter of an opening part of the spiral separator is larger than the bottom diameter of the spiral separator, the included angle between the side wall of the spiral separator and a horizontal line is 0-50°, the distance from the tapered basket to the side wall is 6-35 mm, the surface smoothness Ra of a material inside the tapered basket is smaller than or equal to 0.8, a plurality of de-oiling holes are distributed in the tapered basket, and the de-oiling boles have the sizes smaller than those of the dripping pills and the open porosity of 50-60%.

The transmission channel has a bending angle larger than 90°, which is beneficial to the transmission of the materials with high solid content and realization of automatic continuous feeding.

The dripping pills enter the spiral separator via the distribution hopper, are guided along with a spiral structure inside the spiral separator while rotating and finally fall off along the edge of the spiral separator so as to enter a finished product discharging hole 41, and the liquid paraffin flows out along the holes in the tapered basket under the action of a centrifugal force in a process of high-speed rotation and enters a paraffin recycling barrel 43 from an outlet 42.

The structure of the distribution hopper 37 can avoid the materials being thrown from a distribution hole during high-speed centrifugation and violent impact, which lead to the material damage.

The spiral structure in the spiral separator 38 plays a guide role, the movement track of the solid material can be determined according to the number of turns of a screw, and control the speed of the solid material in a centrifuge.

The distance between spiral plates in the spiral separator 38 is regulated to control the movement track of the solid material, so that the violent impact under high-speed centrifugation is avoided.

The spiral separator 38 and the tapered basket 39 are of coaxial driving structures, so that material damage caused by violent impact generated by a rotating speed difference is avoided, and meanwhile, the parts are firm in connection, safe in operation and convenient to dismount and mount.

The bottom stricture of the spiral separator 38 is shaped like a circular arc, so that violent impact of the solid material under a high-speed centrifugal force is avoided.

A discharging hole 41 is directly connected with downstream equipment to realize continuous discharging.

The time of de-oiling the dripping pills by the centrifuge is shorter than 30 s, preferably, shorter than 20 s.

The de-oiled dripping pills directly enter a coating machine via the discharging hole 41. The separated paraffin oil enters the recycling barrel 43 via an oil recycling pipe 42 so as to be recycled.

The invention claimed is:

1. An dripping pill machine for continuous liquid solidification comprising:

a feeding device;

a material combining device;

a homogenizing device;

a dripping device; and a de-oiling device sequentially connected via a transmission channel, wherein the de-oiling device comprises:

a horizontal driving shaft; and a spiral separator rotating around the horizontal driving shaft as the center and having a spiral transmission channel, wherein an inlet of the spiral transmission channel is in communication with a distribution hopper, and a plurality of de-oiling holes having sizes smaller than those of the dripping pills are opened at one side of the spiral transmission channel.

2. The dripping pill machine for continuous liquid solidification of claim 1, wherein the feeding device comprises a hopper, a weighing sensor, a screw transmission device, and a discharging hole.

3. The dripping pill machine for continuous liquid solidification of claim 1, wherein the material combining device comprises a solid feeding hole, a liquid feeding hole, a driving device, a twin-screw structure connected with the driving device, a host shell covering the twin-screw structure, a discharging hole formed in one end of the host shell and a plurality of heaters arranged on the outer wall of the host shell; the twin-screw structure is sequentially divided into a solid feeding section, a liquid feeding section, a material combining section, a de-gassing section and a transmission section; the solid feeding hole is located above the solid feeding section, and a screw of the twin-screw structure on the solid feeding section is a variable-pitch structure; the liquid feeding hole is located above the liquid feeding section, and a screw of the twin-screw structure on the liquid feeding section is a uniform-pitch structure; and the twin-screw structure of the material combining section is an engaged structure.

4. The dripping pill machine for continuous liquid solidification of claim 3, wherein the plurality of heaters arranged on the outer wall of the host shell can be regulated from 0-200° C.

5. The dripping pill machine for continuous liquid solidification of claim 1, wherein the homogenizing device comprises a material channel, a pressure gauge, and a homogenizing pressure regulating valve disposed above the material channel.

6. The dripping pill machine for continuous liquid solidification of claim 5, wherein the pressure is regulated to be 500-2000 MPa.

7. The dripping pill machine for continuous liquid solidification of claim 1, wherein the dripping device comprises:

a dripping tray;

a balance cylinder used for feeding to the dripping tray via a line;

a vibration device connected with the dripping tray and used for driving the dripping tray to vibrate at a vibration frequency of 10-500 Hz; and a charging barrel having a height of 1-10 m and a diameter of 100-1000 mm and being used for containing liquid paraffin, wherein the dripping tray is 300-1000 mm away from the top of the liquid level of the paraffin;

further comprising: a cooling device comprising a compressor, a heat exchanger, and a pump; a discharging hole; an oil filtering device; an oil storage container; and a paraffin oil transmission line.

8. The dripping pill machine for continuous liquid solidification of claim 7, wherein the oil filtering device has a screen mesh structure.

9. The dripping pill machine for continuous liquid solidification of claim 1, wherein the spiral transmission channel comprises a tapered side wall;

a tapered basket covering the outside of the tapered side wall, wherein the above de-oiling holes are formed in the side of the tapered basket; an annular gap is formed between the tapered side wall and the tapered basket, wherein a spiral track is disposed in the annular gap, and the tapered side wall, the tapered basket and the spiral track form the spiral transmission channel; and the tapered side wall has a wide-necked end and a closing-in end, wherein the closing-in end is connected with the distribution hopper, and an outlet of the spiral transmission channel is located in the wide-necked end.

10. The dripping pill machine for continuous liquid solidification of claim 9, wherein the number of turns of the spiral track is not less than 3, and the spiral lead angle is 5-30°.

11. The dripping pill machine of claim 9, wherein the taper of the tapered side wall is 0-25°.

12. The dripping pill machine for continuous liquid solidification of claim 1, wherein a segment of the transmission channel connecting the dripping device and the de-oiling device has a bending angle larger than 90°.

* * * * *